US005565145A

United States Patent [19]

Watson et al.

[11] Patent Number: 5,565,145

[45] Date of Patent: Oct. 15, 1996

[54] COMPOSITIONS COMPRISING ETHOXYLATED/PROPOXYLATED POLYALKYLENEAMINE POLYMERS AS SOIL DISPERSING AGENTS

[75] Inventors: Randall A. Watson; Eugene P. Gosselink, both of Cincinnati; Shulin Zhang, West Chester, all of Ohio

[73] Assignee: The Procter & Gamble Company, Cincinnati, Ohio

[21] Appl. No.: 587,254

[22] Filed: Jan. 16, 1996

Related U.S. Application Data

[63] Continuation of Ser. No. 248,950, May 25, 1994, abandoned.

[51] Int. Cl.[6] ..... C11D 3/30; C11D 3/37

[52] U.S. Cl. ..... 510/350; 510/299; 510/320; 510/499; 510/535

[58] Field of Search ..... 564/301, 505, 564/511, 512; 252/544, 174.21, 174.23, DIG. 2

[56] References Cited

U.S. PATENT DOCUMENTS

| | | | |
|---|---|---|---|
| 3,301,783 | 1/1967 | Dickson | 252/47.5 |
| 3,489,686 | 1/1970 | Parran, Jr. | 252/106 |
| 3,549,542 | 12/1970 | Holderby | 252/137 |
| 3,549,546 | 12/1970 | Moore | 252/152 |
| 3,580,853 | 5/1971 | Parran, Jr. | 252/152 |
| 3,838,057 | 9/1974 | Barnes et al. | 252/117 |
| 4,171,278 | 10/1979 | Andree et al. | 252/102 |
| 4,267,088 | 5/1981 | Kempf | 260/29.2 |
| 4,386,000 | 5/1983 | Turner et al. | 252/8.8 |
| 4,415,705 | 11/1983 | Hutter | 525/167.5 |
| 4,548,744 | 10/1985 | Connor | 252/545 |
| 4,551,506 | 11/1985 | Gosselink | 528/417 |
| 4,561,991 | 12/1985 | Herbots et al. | 252/118 |
| 4,597,898 | 7/1986 | Vander Meer | 252/529 |
| 4,614,762 | 9/1986 | Marans et al. | 525/61 |
| 4,622,378 | 11/1986 | Gosselink | 528/66 |
| 4,634,544 | 1/1987 | Weber et al. | 252/99 |
| 4,645,611 | 2/1987 | Campbell et al. | 252/62.51 |
| 4,654,043 | 3/1987 | Streit et al. | 8/189 |
| 4,659,382 | 4/1987 | Kang | 106/22 |
| 4,659,802 | 4/1987 | Rubingh et al. | 528/405 |
| 4,661,288 | 4/1987 | Rubingh et al. | 252/545 |
| 4,664,848 | 5/1987 | Oh et al. | 252/547 |
| 4,676,921 | 6/1987 | Vander Meer | 252/174.23 |
| 4,689,167 | 8/1987 | Collins et al. | 252/95 |
| 4,789,400 | 12/1988 | Solodar et al. | 106/22 |
| 4,891,160 | 1/1990 | Vander Meer | 252/545 |
| 4,967,008 | 10/1990 | Friedli et al. | 564/512 |
| 5,129,948 | 7/1992 | Breton et al. | 106/22 |
| 5,183,601 | 2/1993 | Jisai et al. | 252/524 |
| 5,223,028 | 6/1993 | Aulick et al. | 106/22 |

FOREIGN PATENT DOCUMENTS

| | | | |
|---|---|---|---|
| 0042187 | 12/1981 | European Pat. Off. | C11D 3/30 |
| 0062220 | 10/1982 | European Pat. Off. | C10L 1/32 |
| 0206513 | 12/1986 | European Pat. Off. | C11D 3/30 |
| 1111708 | 5/1968 | United Kingdom | C11D 5/00 |

*Primary Examiner*—Erin M. Harriman
*Attorney, Agent, or Firm*—M. D. Jones; K. W. Zerby; J. J. Yetter

[57] ABSTRACT

Cleaning and soil dispersing compositions comprising ethoxylated/propoxylated polyalkyleneamine polymers are provided. Thus, detergent compositions which comprise ethoxylated/propoxylated polyalkyleneamine polymers, such as poly(ethyleneimine) with a degree of ethoxylation of 1.0, provide soil dispersing performance in the wash liquor and whitening and/or cleaning benefits to fabrics, hard-surfaces, or dishware.

18 Claims, No Drawings

COMPOSITIONS COMPRISING ETHOXYLATED/PROPOXYLATED POLYALKYLENEAMINE POLYMERS AS SOIL DISPERSING AGENTS

This is a continuation of application Ser. No. 08/248,950, filed on May 25, 1994 now abandoned.

TECHNICAL FIELD

The present invention relates to cleaning and soil suspending compositions which employ alkoxylated, especially ethoxylated and/or propoxylated, polyalkyleneamine polymers to boost soil dispersing performance. Fabric laundering, dishwashing and hard-surface cleaning compositions with improved soil dispersing properties are provided.

BACKGROUND OF THE INVENTION

Detergent formulators are faced with the task of devising products to remove a broad spectrum of soils and stains from fabrics. Chemically and physico-chemically, the varieties of soils and stains ranges the spectrum from polar soils, such as proteinaceous, clay, and inorganic soils, to non-polar soils, such as soot, carbon-black, byproducts of incomplete hydrocarbon combustion, and organic soils. Detergent compositions have become more complex as formulators attempt to provide products which handle all types concurrently.

Formulators have been highly successful in developing traditional dispersants which are particularly useful in suspending polar, highly charged, hydrophilic particles such as clay. As yet, however, dispersants designed to disperse and suspend non-polar, hydrophobic-type soils and particulates have been more difficult to develop. Without wishing to be limited by theory, it is believed that the first step for dispersion formation is the adsorbance of the soil dispersing agent onto the soil of interest. For clay-like soils, the soil dispersing agent must adsorb onto either a negatively charged surface or positively charged edge. For organic particulates, the soil dispersing agent must adsorb onto a hydrophobic surface with little or no charge. Hence, for polar soils, like clay, a dispersing agent with some charge, such as charged, highly ethoxylated polyamines, are employed. However, these charged dispersing agents have no drying force for adsorbing onto organic, non-polar particulates.

It has now been discovered that compositions comprising substantially noncharged, alkoxylated, especially ethoxylated/propoxylated, polyalkyleneamine polymers can be used to provide effective, improved soil dispersing (especially on non-polar soils) in wash liquors. Further, said ethoxylated/propoxylated polyalkyleneamine polymers appear to whiten/clean fabrics and boost the cleaning performance of hard surface and dishware detergent compositions.

Accordingly, it is an object of the present invention to provide improved cleaning and soil dispersing compositions using substantially noncharged, ethoxylated/propoxylated polyalkyleneamine polymers. It is another object herein to provide a means for dispersing soils and providing whitening/cleaning benefits to fabrics and dishware using the soil dispersing systems of this invention. These and other objects are secured herein, as will be seen from the following disclosures.

BACKGROUND ART

The use of ethoxylated amines is reported in the following U.S. Pat. Nos.: 4,891,160; 4,676,921; and 4,597,898. Additional uses of polyalkyleneamines polymers are reported in the following U.S. Pat. Nos.: 5,183,601; 4,654,043; 4,645,611; 4,634,544; and 4,171,278. Also see European Patent Application 206,513 A1 and 042,187 A1.

SUMMARY OF THE INVENTION

The present invention encompasses soil dispersing compositions comprising substantially noncharged alkoxylated, preferably ethoxylated and or propoxylated, polyalkyleneamine polymers.

When used herein the term "ethoxylate/propoxylate" means those alkoxylate units which are within the scope of this invention as defined hereinafter. The ethoxylated/propoxylated polyalkyleneamine polymers are used in an effective amount in the compositions and processes herein. By "effective amount" is meant an amount which is sufficient, under whatever comparative test conditions are employed, to enhance the dispersion of soils in wash liquors and to provide whitening and/or cleaning to the target substrate. Thus, in a fabric laundering operation, the target substrate will typically be a fabric stained with, for example, various food stains. For automatic dishwashing, the target substrate may be, for example, a porcelain cup or plate with tea stain or a polyethylene plate stained with beef gravy. The test conditions will vary, depending on the type of washing appliance used and the habits of the user. Thus, front-loading laundry washing machines of the type employed in Europe generally use less water and higher detergent concentrations than do top-loading U.S.-style machines. Some machines have considerably longer wash cycles than others. Some users elect to use very hot water; others use warm or even cold water in fabric laundering operations. Of course, the performance of the soil dispersing agent will be affected by such considerations, and the levels used in fully-formulated detergent and soil dispersing compositions can be appropriately adjusted.

Preferably, the soil dispersing compositions comprise at least about 0.1%, preferably from about 0.1% to about 15%, more preferably from about 0.5% to about 10%, by weight of composition, of ethoxylated/propoxylated polyalkyleneamine polymers. The polyalkyleneamines comprise a nitrogen-containing backbone with an average molecular weight of from about 600 to about 10,000, preferably from about 1,000 to about 3,000. Said polymers have an average alkoxylation of from about 0.5 to about 10, preferably from about 0.7 to about 8, most preferably from about 0.7 to about 4, per nitrogen. Further said alkoxylated polyalkyleneamine polymers may comprise up to about 4, but preferably 1 or less, propoxylates or longer alkoxylate units per available site on the nitrogens. By "per available site on the nitrogens" is meant that each H of the NH moiety can be substituted with up to about 4 propoxylates or longer alkoxylate units. Thus, after alkoxylation of a $NH_2$ site, there can then be up to 8 propoxylates or long alkoxylate units connected to the nitrogen. Preferably, the propoxylate or longer alkoxylate units in the alkoxylate systems are added to the polyalkylene-amine first, before the ethoxylate units.

The invention further encompasses compositions comprising from about 1% to about 55% of a detersive surfactant and ethoxylated/propoxylated polyalkyleneamine polymers.

Additionally, the invention encompasses detergent compositions, including laundry detergents, detergent bars, automatic dishwashing detergents, and hard-surface cleaners, comprising conventional suffactants and other detersive ingredients.

The invention also encompasses a method for improving the soil dispersing performance of detergent compositions, comprising adding thereto an effective amount of an ethoxylated/propoxylated polyalkyleneamine polymer. This provides a method for whitening and/or cleaning fabrics, hard-surfaces, or dishware comprising contacting said fabrics, hard-surfaces, or dishware with an aqueous medium comprising said compositions. Again, without wishing to be limited by theory, it is believed that the whitening/cleaning benefits are obtained by the suspension of the soil and particulate material in the wash liquor, thus preventing its redeposition onto the fabric or other surfaces in the wash liquor. These benefits appear after repeated soiling/washing cycles. The number of cycles necessary for the benefit to become visible is dependent on the level of soil dispersing agent used in the wash cycle, the level of soiling present in the wash liquor, and the overall efficiency of the base detergent to which the soil dispersing agent is added.

As a practical matter, and not by way of limitation, the compositions and processes herein can be adjusted to provide on the order of at least one part per ten million of the active ethoxylated/propoxylated polyalkyleneamine polymer species in the aqueous washing medium, and will preferably provide from about 0.1 ppm to about 700 ppm, more preferably from about 0.5 ppm to about 500 ppm, most preferably from about 1 ppm to about 100 ppm, of the ethoxylated/propoxylated polyalkyleneamine polymer species in the washing medium.

All percentages, ratios and proportions herein are by weight, unless otherwise specified. All documents cited are, in relevant part, incorporated herein by reference.

DETAILED DESCRIPTION OF THE INVENTION

In contrast to the charged polymers in the art, the ethoxylated/propoxylated polyalkyleneamine polymers of this invention are substantially noncharged, low molecular weight, water soluble, and lightly alkoxylated, preferably ethoxylated/propoxylated. By "lightly" is meant the polymers of this invention average from about 0.5 to about 10 alkoxylations per nitrogen. By "substantially noncharged" is meant that there is no more than about 2 positive charges for every 40 nitrogens present in the backbone of the polyalkyleneamine polymer.

The preferred ethoxylated/propoxylated polyalkyleneamines of this invention are of the formula:

$$[(R^2)_2N]_w-[R^1-\underset{\underset{B}{|}}{N}]_x-[R^1-\underset{\underset{R^2}{|}}{N}]_y-[R^1-\underset{\underset{(R^2)_2}{|}}{N}]_z$$

wherein each $R^1$ is independently $C_2$–$C_{12}$ alkylene, alkenylene, arylene or alkarylene; each $R^2$ is independently H, a straight, branched, or cyclic $C_1$–$C_8$ alkyl moiety, phenyl, benzyl, a $C_1$–$C_8$ aroyl or alkanoyl moiety, especially benzoyl, or the moiety —L—X, wherein X is a nonionic group, especially H, or an anionic group, such as sulfate, and L is a hydrophilic chain which contains the polyoxyalkylene moiety $[(R^5O)_{m'}(CH_2CH_2O)_{n'}-(R^5O)_{m''}(CH_2CH_2O)_{n''}]$, wherein each $R^5$ is independently H, $C_3$–$C_4$ alkylene or hydroxyalkylene, m'+m"=m, n'+n"=n, wherein m is from 0 to about 4, n is from 0 to about 16, preferably from about 0 to about 10, m+n is from about 1 to about 16, preferably from about 1 to about 10, and provided that at least 0.5 of the $R^2$ moieties per nitrogen is —L—X; w is 1 or 0; x+y+z is at least 14; and B represents a continuation of this structure by branching. Said polymer has an average alkoxylation of from about 0.5 to about 10 per nitrogen.

Although branched backbones are preferred, linear and cyclic polymer backbones are possible. The relative proportions of primary, secondary and tertiary amine groups present in the polymer prior to alkoxylation can vary, depending on the manner of preparation. The distribution of amine groups is typically as follows:

$—CH_2CH_2—NH_2$ 25%

$—CH_2CH_2—NH—$ 50%

$—CH_2CH_2—N—$ 25%.

In the preceding formula, $R^1$ can be branched or linear (e.g. $—CH_2CH_2—$, $—CH_2—CH_2—CH_2—$, $—CH_2—C(C_6H_5)H—$, alkylene, alkenylene, alkarylene. $R^1$ is preferably $C_2$–$C_6$ alkylene. However, for the ethoxylated polyalkyleneamines and polyalkyleneimines, especially at higher molecular weights, $C_2$–$C_3$ alkylenes (ethylene, propylene) are preferred for $R^1$ with ethylene being most preferred.

At least 0.5 of the $R^2$ moieties per nitrogen is preferably the moiety —L—X. In the preceding formula, hydrophilic chain L usually consists entirely of the polyoxyalkylene moiety $[(R^5O)_{m'}(CH_2CH_2O)_{n'}—, (R^5O)_{m''}(CH_2CH_2O)_{n''}]$. The moieties $—(R^5O)_{m' \text{ or } m''}—$ and $—(CH_2CH_2O)_{n' \text{ or } n''}—$ of the polyoxyalkylene moiety can be mixed together (e.g., random ordered) or preferably form blocks of $—(R^5O)_{m' \text{ or } m''}—$ and $—(CH_2CH_2O)_{n' \text{ or } n''}—$ moieties. $R^5$ is preferably $C_3H_6$ (propylene). For this invention, m is preferably from 0 to about 4, most preferably 0, i.e., the polyoxyalkylene moiety consists entirely of the moiety $—(CH_2CH_2O)_{n' \text{ or } n''}—$. The moiety $—(CH_2CH_2O)_{n' \text{ or } n''}—$ preferably comprises on average at least about 85% by weight of the polyoxyalkylene moiety and most preferably 100% by weight (i.e., when m is 0).

In the preceding formula, X can be any compatible anionic group, especially sulfate, or nonionic group. Suitable nonionic groups include $C_1$–$C_4$ alkyl or hydroxyalkyl ester or ether groups, preferably the acetate ester or methyl ether, respectively; hydrogen (H); or mixtures thereof. The particularly preferred nonionic group is H.

Particularly preferred ethoxylated/propoxylated polyalkylamine polymers are the ethoxylated $C_2$–$C_3$ polyalkyleneamines and polyalkyleneimines, such as the ethoxylated polyethyleneamines (PEAs) and polyethyleneimines (PEIs). These preferred compounds are exemplified by the following structure with an average degree of ethoxylation of 1.0:

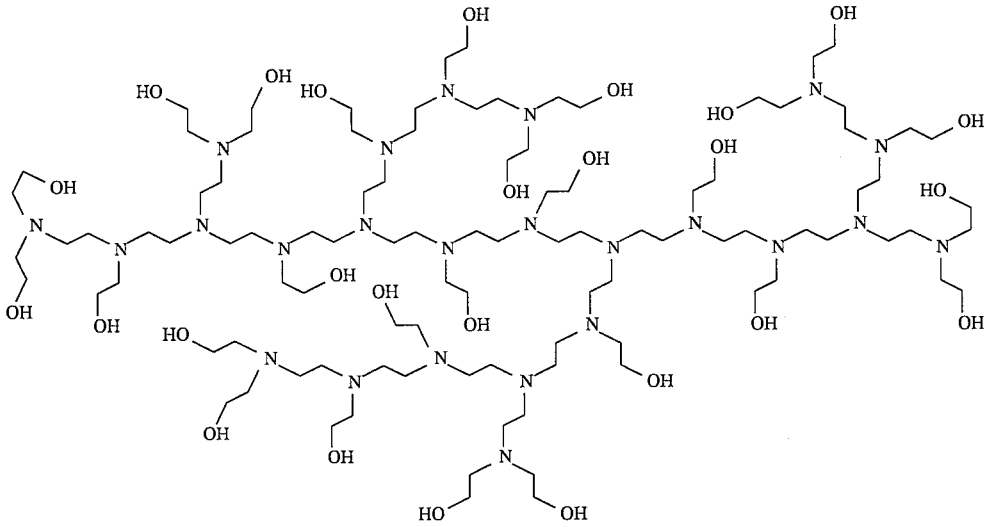

Other polymers are exemplified by the following structure:

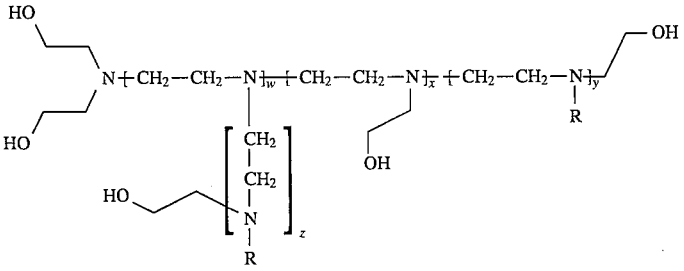

wherein each R is independently $—CH_2(C_6H_5)$, $—C(O)(C_6H_5)$, $—(CH_2CH_2O)_nH$, $—(CH_2CH_2CH_2O)(CH_2CH_2O)_nOCH_3$, $—(CH(CH_3)CH_2CH_2O)(CH_2CH_2O)_nOCH_3$, wherein n is from about 1 to about 16, and $—CH_2CH(OH)CH_3$.

In the polyalkyleneimines and polyalkyleneamines, each hydrogen atom attached to each nitrogen atom represents an active site for subsequent ethoxylation. These PEAs can be obtained by reactions involving ammonia and ethylene dichloride. See U.S. Pat. No. 2,792,372 to Dickson, issued May 14, 1957, which describes the preparation of PEAs.

The PEIs used in preparing the compounds of the present invention have a molecular weight of at least about 600 prior to ethoxylation, which represents at least about 14 units. The polymer backbone of these PEIs can be exemplified by the structure:

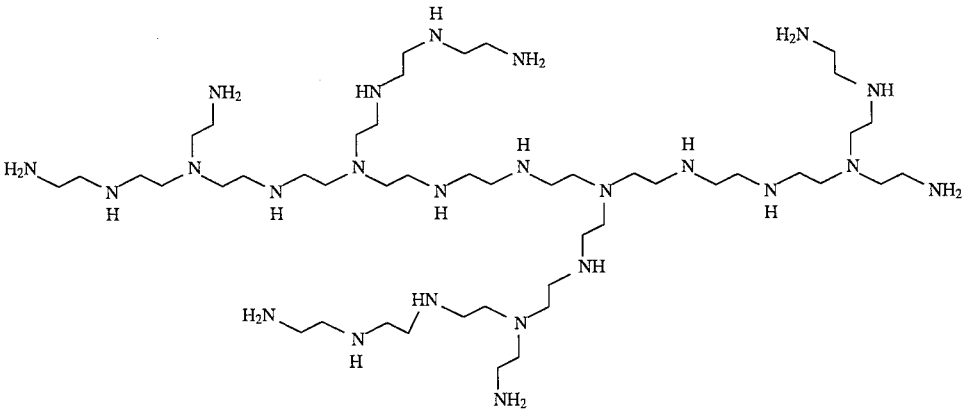

Each hydrogen atom attached to each nitrogen atom of the PEI represents an active site for subsequent alkoxylation. These PEIs can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing PEIs are disclosed in U.S. Pat. No. 2,182,306 to Ulrich et al., issued Dec. 5, 1939; U.S. Pat. No. 3,033,746 to Mayle et al., issued May 8, 1962; U.S. Pat. No. 2,208,095 to Esselmann et al., issued Jul. 16, 1940; U.S. Pat. No. 2,806,839 to Crowther, issued Sep. 17, 1957; and U.S. Pat. No. 2,533,696 to Wilson, issued May 21, 1951 (all herein incorporated by reference).

Methods for Making Ethoxylated Amines

The ethoxylated compounds of the present invention can be prepared by standard methods for ethoxylating amines. For the polyamines such as the polyalkyleneamines and polyalkyleneimines, there is preferably an initial step of condensing sufficient ethylene oxide to provide 2-hydroxyethyl groups at each reactive site (hydroxyethylation). The appropriate amount of ethylene oxide is then condensed with these 2-hydroxyethylamines using an alkali metal (e.g., sodium or potassium) hydride or hydroxide as the catalyst to provide the respective ethoxylated amines. If desired, the alkali metal catalyst can be added when the hydroxyethylation step is incomplete. This results in a less uniform distribution of ethoxylation across the reactive sites than when the catalyst is added after hydroxyethylation is complete. The total degree of ethoxylation per reactive site (NH) can be determined according to the following formula:

$$\text{Degree of Ethoxylation}=E/(AR)$$

wherein E is the total number of moles of ethylene oxide condensed (including hydroxyethylation), A is the number of moles of the starting amine, and R is the number of reactive sites for the starting amine.

As indicated hereinbefore, the alkoxylated polyalkyleneamines of this invention are substantially noncharged, although it is recognized that a limited number of positively charged sites may be present in the polymers. Thus, this invention includes those polymers which have up to about 2 charged sites per 40 nitrogen sites. The charged sites may be formed by quaternization or by hydrogen protonation. It is believed, however, that the preferred pH ranges of this invention ensures that the soil dispersing agents of this invention remain essentially uncharged in the washing solution. When the soil dispersing agents of this invention are used, optimum performance is obtained with washing solutions wherein the pH of such solution is above about 9, preferably between about 9.5 and 12. Such pH can be obtained with substances commonly known as buffering agents, which are optional components of the bleaching systems herein.

Adjunct Ingredients

The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of such adjunct materials.

Detersive Surfactants

Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-( 3-methoxypropyl) glucamide. The N-propyl through N-hexyl $C_{12}$–$C_{18}$ glucamides can be used for low sudsing. $C_{10}$–$C_{18}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Liquid formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as titrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-Na $_2SiO_5$ morphology form of layered silicate. It can be prepared by methods such as those described in German DE-A-3,417,649 and DE-A-3,742,043.

SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially titrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy- 1,1-diphosphonate and other known phosphonates (see, for example, U.S. Pat. Nos. 3,159,581; 3,213,030; 3,422,021; 3,400,148 and 3,422,137) can also be used.

Enzymes

Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985). Most preferred is what is called herein "Protease C", which is a variant of an alkaline serine protease from Bacillus, particularly *Bacillus lentus*, in which arginine replaced lysine at position 27, tyrosine replaced valine at position 104, serine replaced asparagine at position 123, and alanine replaced threonine at position 274. Protease C is described in EP 90915958:4; U.S. Pat. No. 5,185,250; and U.S. Pat. No. 5,204,015. Also preferred are protease which are described in copending application U.S. Ser. No. 08/136,797, entitled "Protease-Containing Cleaning Compositions" and copending application U.S. Ser. No. 08/136,626, entitled "Bleaching Compositions Comprising Protease Enzymes", which are incorporated herein by reference. Genetically modified variants, particularly of Protease C, are also included herein.

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* vat. lipolyticum NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli*. The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/0998 13, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Enzyme Stabilizers

The enzymes employed herein are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Bleaching Compounds—Bleaching Agents and Bleach Activators

The detergent compositions herein may optionally contain bleaching agents or bleaching compositions containing a bleaching agent and one or more bleach activators when formulated appropriately by those skilled in the art. It is believed that the use of bleaching compounds with the soil dispersing agents of this invention will generally result in a diminution of bleaching performance, which should be taken into account by the formulator. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetra-hydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl)oxybenzenesulfonate, (6-nonanamidocaproyl)oxybenzenesulfonate, (6-decanamido-caproyl)oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

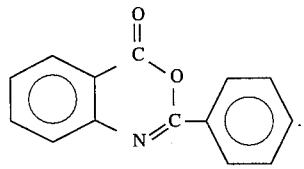

Still another class of preferred bleach activators includes the acyl lactam activators, especially acyl caprolactams and acyl valerolactams of the formulae:

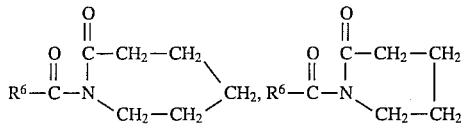

wherein $R^6$ is H, an alkyl, aryl, alkoxyaryl, or alkaryl group containing from 1 to about 12 carbon atoms, or a substituted phenyl group containing from about 6 to about 18 carbons. See copending U.S. application Ser. Nos. 08/064,562 and 08/082,270, which disclose substituted benzoyl lactams. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}{}_2(u\text{-}O)_3$(1,4,7-trimethyl-1,4,7-triazacyclononane) $_2(PF_6)_2$, $Mn^{III}{}_2(u\text{-}O)_1(u\text{-}OAc)_2$ (1,4,7-trimethyl-1,4,7-triazacyclononane) $_2\text{-}(ClO_4)_2$, $Mn^{IV}{}_4(u\text{-}O)_6$(1,4,7-triazacyclono-nane)$_4(ClO_4)_4$, $Mn^{III}Mn^{IV}{}_4(u\text{-}O)_1(u\text{-}OAc)_2$-(1,4,7-trimethyl- 1,4,7-triazacyclono-nane)$_2(ClO_4)_3$, $Mn^{IV}$(1,4,7-trimethyl-1,4,7-triazacyclononane)- $(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing medium, and will preferably provide from about 0.1 ppm to about 700 ppm, more preferably from about 1 ppm to about 500 ppm, of the catalyst species in the laundry liquor.

Polymeric Soil Release Agent

In addition to the soil dispersing agents of this invention, any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient mount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly(vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al.

Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

Still another preferred soil release agent is an oligomer with repeat units of terephthaloyl units, sulfoisophthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy- 1,2-propyleneoxy units in a ratio of from about 1.7 to about 1.8, and two end-cap units derived from sodium 2-(2-hydroxyethoxy)ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

If utilized, soil release agents will generally comprise from about 0.01% to about 10.0%, by weight, of the detergent compositions herein, typically from about 0.1% to about 5%, preferably from about 0.2% to about 3.0%.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylene-diamine tetraproprionates, triethylenetetraaminehexacetates, diethylenetriaminepenta-acetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions.

Clay Soil Removal/Anti-redeposition Agents

In addition to the soil dispersing agents of this invention, the compositions of the present invention can also optionally contain charged, water-soluble, highly ethoxylated amines having polar and clay soil removal and antiredeposition properties. Granular detergent compositions which contain these compounds typically contain from about 0.01% to about 10.0% by weight of the charged, highly ethoxylated amines; liquid detergent compositions typically contain about 0.01% to about 5%.

If employed, the most preferred soil release and anti-redeposition agent useful in this invention is a quaternized ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111, 965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other charged clay soil removal and/or anti redeposition agents known in the art can also be utilized in the compositions herein. Another type of preferred antiredeposition agent includes the carboxy methyl cellulose (CMC) materials. These materials are well known in the art.

Polymeric Dispersing Agents

Optionally, additional polymeric dispersing agents can advantageously be utilized at levels from about 0.1% to about 7%, by weight, in the compositions herein, especially in the presence of zeolite and/or layered silicate builders. If employed in the compositions herein, suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Brightener

Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy, Artic White CC and Artic White CWD, available from Hilton-Davis, located in Italy, the 2-(4-stryl-phenyl)-2H-napthol[1,2-d]triazoles; 4,4'-bis- (1,2,3-triazol-2-yl)-stil- benes; 4,4'-bis(stryl)bisphenyls; and the aminocoumarins. Specific examples of these brighteners include 4-methyl-7-diethyl- amino coumarin; 1,2-bis(-venzimidazol-2-yl)ethylene; 1,3-diphenyl-phrazolines; 2,5-bis-(benzoxazol-2-yl)thiophene; 2-strylnapth-[1,2-d]oxazole; and 2-(stilbene-4-yl)-2H-naphtho- [1,2-d]triazole. See also U.S. Pat. No. 3,646,015, issued Feb. 29, 1972 to Hamilton. Anionic brighteners are preferred herein.

Suds Suppressors

Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C.

(atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from about 0.6:1 to about 1.2: 1; and (iii) from about 1 to about 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, typical liquid laundry detergent compositions with controlled suds will optionally comprise from about 0.001 to about 1, preferably from about 0.01 to about 0.7, most preferably from about 0.05 to about 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. No. 4,978,471, Starch, issued Dec. 18, 1990, and U.S. Pat. No. 4,983,316, Starch, issued Jan. 8, 1991, U.S. Pat. No. 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing mount". By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher mounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Fabric Softeners

Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981.

Dye Transfer Inhibiting Agents

In addition to the soil dispersing agents herein, the compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: $R—A_x—P$; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

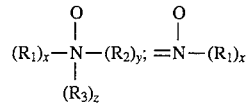

wherein $R_1$, $R_2$, $R_3$ are aliphatic, aromatic, heterocyclic or alicyclic groups or combinations thereof, x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modem Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

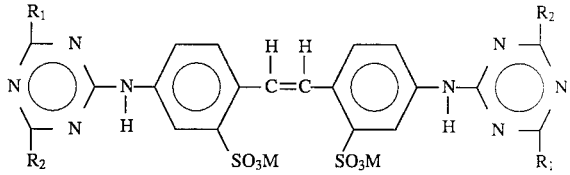

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine- 2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N- 2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R^1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quickly on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Other Ingredients

A wide variety of other ingredients useful in detergent compositions can be included in the compositions herein, including other active ingredients, carders, hydrotropes, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, typically, 0.1%–2%, to provide additional suds and to enhance grease removal performance.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between about 6.5 and about 12, preferably between about 7.5 and 11. Techniques for controlling pH at recommended usage levels include the use of buffers, alkalis, acids, etc., and are well known to those skilled in the art.

EXAMPLE I

Ethoxylation of Poly(ethyleneimine) With Average Molecular Weight of 1,200

To a 250 ml 3-neck round bottom flask equipped with a claisen head, thermometer connected to a temperature controller (Therm-O-Watch™, $I^2R$), sparging tube, and mechanical stirrer is added poly(ethyleneimine) MW 1200 (Polysciences, 65.6 g 0.055 mole). Ethylene oxide gas (Liquid Carbonics) is added via the sparging tube under argon at approximately 140° C. with very rapid stirring until a weight gain of 16.8 g (corresponding to 0.25 ethoxy units) is obtained. A 25 g portion of this yellow gel-like material is saved. Ethylene oxide is added to the remaining material as described above until a weight gain of 11.7 g (corresponding to a total of 0.50 ethoxy units) is obtained. A 25 g portion of this yellow gel-like material is saved. Ethylene oxide is added to the remaining material as described above until a weight gain of 8.3 g (corresponding to a total of 0.78 ethoxy units) is obtained. A 25 g portion of this yellow gel-like material is saved. Ethylene oxide is added to the remaining material as described above until a weight gain of 3.4 g (corresponding to a total of 1 ethoxy unit) is obtained to afford 27.4 g of orange gel-like material.

EXAMPLE II

Ethoxylation of Poly(ethyleneimine) With Average Molecular Weight of 1,800

To a 250 ml 3-neck round bottom flask equipped with a claisen head, thermometer connected to a temperature controller (Therm-O-Watch™, $I^2R$), sparging tube, and mechanical stirrer is added poly(ethyleneimine) MW 1800

(Polysciences, 50.0 g, 0.028 mole). Ethylene oxide gas (Liquid Carbonics) is added via the sparging tube under argon at approximately 140° C. with very rapid stirring until a weight gain of 52 g (corresponding to 1.2 ethoxy units) is obtained. A 50 g portion of this yellow gel-like material is saved. To the remaining material is added potassium hydroxide pellets (Baker, 0.30 g, 0.0053 mol). after the potassium hydroxide dissolves, ethylene oxide is added as described above until a weight gain of 60 g (corresponding to a total of 4.2 ethoxy units) is obtained. A 53 g portion of this brown viscous liquid is saved. Ethylene oxide is added to the remaining material as described above until a weight gain of 35.9 g (corresponding to a total of 7.1 ethoxy units) is obtained to afford 94.9 g of dark brown liquid. The potassium hydroxide in the latter two samples is neutralized by adding the theoretical amounts of methanesulfonic acid.

EXAMPLE III

Benzylation of Poly(ethyleneimine) MW 1800 to 10 Mole % Relative to Nitrogens, and Its Subsequent Ethoxylation A 100 mL, three neck, round bottom flask is equipped with a magnetic stir bar, a condenser, a thermometer, a temperature control device (Therm-O-Watch™, $I^2R$), and an addition funnel. To this reaction flask is added the poly(ethyleneimine) MW 1800 (Polysciences Inc, 20.0 g, 0.011 moles). To the addition funnel is added the benzyl chloride (Aldrich, 5.9 g, 0.047 moles), which is enough to react with 10 mole % of the available nitrogens in the poly(ethyleneimine). The reaction flask is now heated to 100° C. under argon, and at this temperature the benzyl chloride is dripped in at a rate of about 1 drop every 3 seconds. An exotherm of approximately 10° C. is noted during the addition procedure. After the addition of benzyl chloride is complete, the reaction heating is continued at 100° C. under argon for 5 hours. After a brief cooling period, the orange colored product is dissolved in methanol to form a 20% solution by weight. To this solution is added the theoretical amount of a 25% solution by weight of sodium methoxide in methanol (Aldrich, 10.1 g, 0.047 moles) to neutralize the HCl formed during the reaction. The precipitated salt is removed from the yellow solution by filtration using aspirator vacuum. The solution is then stripped of methanol on a rotary evaporator (Büchi) at 50° C. and aspirator vacuum to give benzylated PEI- 1800.

Ethoxylation of Benzylated PEI-1800

A 250 mL, three neck, round bottom flask is equipped with a gas inlet tube with a fitted glass tip, a thermometer, a temperature control device (Therm-O-Watch™, $I^2R$), and a motorized stirrer with a glass shaft and Teflon blade. The benzylated poly(ethyleneimine) (10.2 g, 0.005 moles) as prepared above is placed in the reaction flask. The reaction is taken up to 150° C. under argon, with vigorous stirring. At this point, ethylene oxide (Liquid Carbonics) is bubbled into the reaction vessel until a weight gain of 3.7 g is noted in the product (this weight gain corresponds to an E=0.5 level of ethoxylation relative to the available nitrogen sites on the polymer). A portion of this product (4.1 g) is removed from the reaction vessel, and the reaction temperature is sustained at 150° C. The flow of ethylene oxide into the reaction is continued until a product weight gain of 2.7 g is achieved (E=1 level of ethoxylation). A portion of the brown product oil (5.4 g) is removed from the reaction, and 1 mole % of potassium hydroxide is added as a catalyst. The ethylene oxide flow is continued until an additional 13.4 g of weight gain is noted in the product (E=5.6 level of ethoxylation). Again, a portion of this product (9.5 g) is removed and the ethoxylation continued as above after additional potassium hydroxide catalyst (0.112 g) is added. The product gains 12.8 g of weight during this leg of the ethoxylation procedure (E=14). The ethoxylation is discontinued, and this final product saved. The base catalyst in the last two ethoxylations is neutralized with methanesulfonic acid (Aldrich). Each of the polymer samples is tested for water solubility in deionized water in small screw cap vials. The E=5.6 and E=14 samples are soluble at 10% solution by weight, and the E=1 sample is soluble at 1% solution. The E=0.5 sample is only partially soluble at 1% solution. A slightly cloudy suspension is formed in this case.

EXAMPLE IV

Synthesis of Poly(ethyleneimine) MW 1800, Propoxylated to P=1, and Then Ethoxylated to E=6.5 and 10.1

A 250 mL, three neck, round bottom flask is equipped with a magnetic stir bar, a dry ice condenser, an addition funnel, a thermometer, and a temperature control device (Therm-O-Watch™, $I^2R$). To this reaction flask is added the poly(ethyleneimine) MW 1800 (Polysciences Inc., 20.2 g, 0.011 moles), and an equal mass of distilled water. To the addition funnel is added the propylene oxide (Aldrich, 11.8 g, 0.203 moles). The reaction flask is now heated to 80° C. under argon, and at this temperature the propylene oxide is dripped into the reaction in small increments over an hour. The addition of the propylene oxide causes an exotherm. Therefore, the addition rate is controlled so that the reaction temperature never goes over about 90° C. After all of the propylene oxide has been added, the heating of the reaction mixture is continued for another hour until no further propylene oxide reflux is observed. The product solution is transferred to a 250 mL round bottom flask, and stripped of water on the rotary evaporator (Büchi) at 60° C. and aspirator vacuum. To part of the viscous, transparent yellow product (35.1 g, 0.008 moles) is added 3.8 g of a 25% solution of sodium methoxide in methanol (Aldrich). The flask is then put on the Kugelrohr (Aldrich) at 160° C. and 2 mm Hg for 5 hours until all of the methoxide salt is dissolved and the methanol and any residual water distilled off.

The above product (17.0 g, 0.004 moles) is transferred to a 250 mL, three neck, round bottom flask equipped with a gas inlet tube with a fritted glass tip, a thermometer, a temperature control device (Therm-O-Watch™, $I^2R$), and a motorized stirrer with a glass shaft and Teflon blade. The reaction is taken up to 150° C. under argon, with vigorous stirring. At this point, the reaction vessel is thoroughly flushed with a heavy stream of argon for approximately 15 minutes. The ethylene oxide gas (Liquid Carbonics) is then bubbled through the reaction until a weight gain of 45.0 g is noted in the product (this weight gain corresponds to an E=6.5 level of ethoxylation relative to the available nitrogen sites on the polymer). A portion of the golden colored product (30.2 g) is removed from the reaction vessel, and the reaction temperature is maintained at 150° C. The reaction system is again purged at this point with a heavy flow of argon for about 15 minutes. The flow of ethylene oxide is resumed after the purging until a weight gain of 12.5 g is recorded in the product (E=10.1 level of ethoxylation). The product color at this point is essentially the same as the previous E level. The base catalyst in each ethoxylation product is neutralized with methanesulfonic acid (Aldrich). Each of the polymer samples is found to be soluble at 10% solution in deionized water.

EXAMPLE V

Benzoylation (25 mol %) and Subsequent Ethoxylation of Poly(ethyleneimine), MW 600

A 250 mL, three neck, round bottom flask is equipped with a magnetic stir bar, a thermometer, a temperature control device (Therm-O-Watch™, $I^2R$), a modified Claisen head, and a condenser set for distillation. To this reaction flask is added the poly(ethyleneimine), MW 600 (Polysciences Inc., 61.9 g, 0.103 moles), and methyl benzoate (Aldrich, 48.7 g, 0.358 moles). The reaction is heated at 150° C. for 3 hours under argon as methanol distills over. The product is a viscous, bright yellow oil (of which 10 g is saved). About 82.7 g of the product is added to a 500 mL, three neck, round bottom flask equipped with a gas inlet tube with a fitted glass tip, a thermometer, a temperature control device (Therm-O-Watch™, $I^2R$), and a motorized stirrer with a glass shaft and Teflon blade. The reaction is taken up to 150° C. under argon, with vigorous stirring. At this point, ethylene oxide (Liquid Carbonics) is bubbled into the reaction vessel, until a weight gain of 36.0 g is achieved in the product (this weight gain corresponds to about E=1.0 level of ethoxylation relative to the remaining amino nitrogen NH sites on the polymer). A portion of the deep red product (19.6 g) is removed from the reaction vessel and the reaction temperature is maintained at 150° C. Potassium hydroxide catalyst (Baker, 0.48 g, 1 mole %) is added to the reaction and allowed to dissolve. The flow of ethylene oxide is continued into the reaction until a weight gain of 37.1 g is noted (E~2.2 level of ethoxylation). Again, a portion of this brown product oil (49.2 g) is removed, and the ethoxylation continued until an additional 66.4 g of weight gain is noted in the product (E~5.7). The ethoxylation is discontinued and this last dark bown product oil is saved. The base catalyst in the last two ethoxylated products is neutralized with methanesulfonic acid (Aldrich). The 25 mol % benzoylated PEI-600 forms a hazy white solution in deionized water at 1%, indicating very limited solubility. The first two ethoxylation products are fully soluble at 10% solution in deioized water, while the highest E level will not fully dissolve at this concentration.

EXAMPLE VI

Synthesis of MW 2018.5, Subsequent Reaction with Poly(ethyleneimine) MW 1800, and Subsequent Ethoxylation A 100 mL, three neck, round bottom flask is equipped with a stir bar, a condenser, an addition funnel, a thermometer, and a temperature control device (Therm-O-Watch™, $I^2R$). To this reaction flask is added the poly(ethylene glycol), methyl ether MW 2000 (Aldrich, 60.0 g, 0.030 moles). The reaction vessel is taken up to 65° C. in order to melt the poly(ethylene glycol), methyl ether, and then the reaction is cooled to 55° C. and held at this temperature. Thionyl chloride (Aldrich, 11.7 g, 0.100 moles) is placed in the addition funnel, and is dripped into the reaction flask over a 20 minute period. The reaction is heated overnight under argon at 55° C. The light orange colored waxy product is taken up in enough methylene chloride (Baker) to form a 30% solution by weight, and is then stripped on the rotary evaporator at 45° C. and aspirator vacuum. The product pH measures ~2 at this point with pH strips. The product is dissolved again in methylene chloride (Baker) at 30% solution and placed in a separatory funnel. The product solution is washed once with a saturated solution of potassium carbonate (Baker) in water. The methylene chloride layer is drawn off and stripped again on the rotary evaporator under the above conditions. The alpha-(2-chloroethyl)-omega-methoxy-poly(oxy- 1,2-ethanediyl) is obtained as an orange, waxy material.

The alpha-(2-chloroethyl)-omega-methoxy-poly(oxy-1,2-ethanediyl) ( 13.1 g, 0.0065 moles), the poly(ethyleneimine) MW 1800 (Polysciences, Inc., 11.7 g, 0.0065 moles), and enough deionized water to make a 35% solution by weight are added to a 100 mL, three neck, round bottom flask equipped with a stir bar, a condenser, a thermometer, and a temperature control device (Therm-O-Watch™, $I^2R$). The clear reaction solution is heated overnight at 80° C. under argon. After the reaction is completed, the theoretical amount of 50% sodium hydroxide solution (Baker) is added to neutralize the acid formed. The solution is then placed in a 250 mL round bottom flask and stripped on the rotary evaporator at 60° C. and aspirator vacuum. Last traces of water are removed on a Kugelrohr apparatus (Aldrich) under conditions of ~2 mmHg and 120° C. for 3 hours. A portion of the waxy, yellow product (14.2 g, 0.004 moles) is weighed into a 100 mL, three neck, round bottom flask equipped with a gas inlet tube with a fitted glass tip, a thermometer, a temperature control device (Therm-O-Watch™, $I^2R$), and a motorized stirrer with a glass shaft and a Teflon blade. The reaction is taken up to 150° C. under argon, with vigorous stirring. At this point, the ethylene oxide (Liquid Carbonics) is bubbled into the reaction vessel until a weight gain of 3.4 g is noted in the product (this weight gain corresponds to an E=0.7 level of ethoxylation relative to the available nitrogen sites on the polymer. A portion of this dark yellow wax is removed, and the flow of ethylene oxide is continued at 150° C. until a weight gain of 2.7 g is achieved (E=1.1 level of ethoxylation). Again, a portion of this orange product is saved, and 1 mole % potassium hydroxide (Baker) is added as a catalyst. The ethoxylation is continued at 150° C. until a final weight gain of 3.1 g is noted in the product (E=2.0). The base catalyst in this red colored polymer is neutralized with methanesulfonic acid (Aldrich). All polymer samples show good solubility in deionized water at 10% solution.

Example of structure which has degree of ethoxylation=1 except where MPEG is attached:

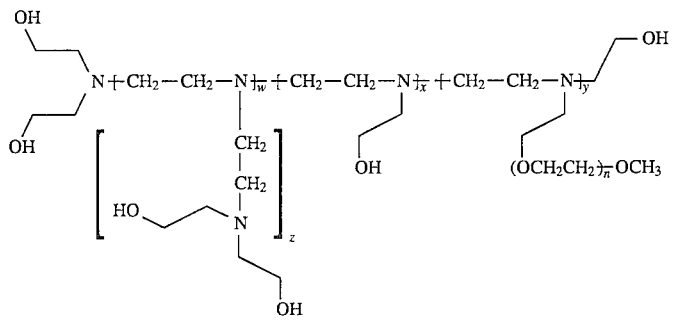

EXAMPLE VII

A granular detergent composition is prepared comprising the following ingredients.

| Component | Weight % |
|---|---|
| $C_{13}$ linear alkyl benzene sulfonate | 22 |
| Phosphate (as sodium tripolyphosphate) | 30 |
| Sodium carbonate | 14 |
| Sodium silicate | 3 |
| Zeolite A (0.1–10 microns) | 8.2 |
| Nonanoyloxybenzenesulfonate | 3.2 |
| Sodium percarbonate* | 4.5 |
| Chelant (diethylenetriaminepentaacetic acid) | 0.4 |
| Sodium sulfate | 5.5 |
| Dispersing agent (Example III) | 0.4 |
| Minors, filler** and water | Balance to 100% |

*Average particle size of 400 to 600 microns.
**Can be selected from convenient materials such as $CaCO_3$, talc, clay, silicates, and the like.

In testing the soil dispersing performance of the dispersing agents, the following test method is used:

White fabrics, including cotton knit, heavy cotton knit, polycotton, terrycloth, 60/40 polycotton, 50/50 polycotton, and 100% polyester, are used in the testing. Using a Sears KENMORE washer, the fabrics are desized with a commercial granular detergent (DASH). The washing is conducted in 0 grains per gallon (gpg) water at a temperature of 120° F. (48.8° C.) for 12 minutes, with subsequent rinsing in 0 gpg water at a temperature of 120° F. (48.8° C.). This desizing step is done twice and is followed by two additional wash cycles using only water. The desized fabrics are formed into swatches (5 inches square).

Testing is done in a 5 pot Automatic Mini-Washer (AMW) to mimic a hand-wash operation using standardized conditions. After the AMW pots are filled with 7.6 liters (2 gallons) of water each, the detergent composition (above) and the dispersing agent are added to each pot. The clean test swatches are then added alone with an amount of unwashed, dirty consumer ballast to bring the water/cloth ratio to the desired level of approximately 0.5:1 to about 15:1 (liters:kg). The consumer ballast is split into equal halves between the dispersing agent containing formula and a pot containing an identical control formula without dispersing agent. The wash cycle is conducted in 8 grains per gallon (gpg) water at a temperature of 77° F. (25° C.) water. The wash cycle consists of a 30 minute soak followed by 10 minute agitation. After the wash cycle, there is a 2 minute spin cycle, followed by two 2-minute rinse cycles using 8 gpg water at a temperature of 77° F. (25° C.). For multi-cycle testing the test swatches are dried and the above steps repeated using the same test swatches and new dirty consumer bundles.

At the end of the last rinse cycle, the test swatches are dried in a dryer. Tristimulus meter readings (L,a,b) are then determined for each test swatch. Whiteness performance in terms of Hunter Whiteness Values (W) is then calculated according to the following equation:

$$W=(7L^2-40Lb)/700$$

The higher the value for W, the better the whiteness performance. All fabrics display improved whiteness after laundering compared with fabrics which have not been exposed to the dispersing agents of this invention.

EXAMPLE VIII

A laundry bar suitable for hand-washing soiled fabrics is prepared by standard extrusion processes and comprises the following:

| Component | Weight % |
|---|---|
| $C_{12}$ linear alkyl benzene sulfonate | 30 |
| Phosphate (as sodium tripolyphosphate) | 7 |
| Sodium carbonate | 25 |
| Sodium pyrophosphate | 7 |
| Coconut monoethanolamide | 2 |
| Zeolite A (0.1–10 micron) | 5 |
| Carboxymethylcellulose | 0.2 |
| Polyacrylate (m.w. 1400) | 0.2 |
| Dispersing agent (Example I) | 0.5 |
| Brightener, perfume | 0.2 |
| Protease | 0.3 |
| $CaSO_4$ | 1 |
| $MgSO_4$ | 1 |
| Water | 4 |
| Filler* | Balance to 100% |

*Can be selected from convenient materials such as $CaCO_3$, talc, clay, silicates, and the like.

In testing the soil dispersing performance of the dispersing agents, the test method used in Example VII is followed. All fabrics display improved whiteness after laundering compared with fabrics which have not been exposed to the soil dispersing agents of this invention.

EXAMPLE IX

A concentrated liquid detergent composition is prepared comprising the following ingredients.

| Component | Weight % |
|---|---|
| $C_{14-15}$ alkyl polyethoxylate (2.25) sulfonic acid | 10.6 |
| $C_{12-13}$ linear alkylbenzene sulfonic acid | 12.5 |
| $C_{12-13}$ alkyl polyethoxylate (6.5) | 2.4 |
| Sodium cumene sulfonate | 6 |

-continued

| Component | Weight % |
|---|---|
| Ethanol | 1.5 |
| 1,2 propanediol | 4 |
| Monoethanolamine | 1 |
| $C_{12-14}$ fatty acid | 2 |
| Dispersing agent (Example II) | 1.5 |
| Sodium hydroxide | to pH 9 or greater |
| Minors, filler* and water | Balance to 100% |

*Can be selected from convenient materials such as $CaCO_3$, talc, clay, silicates, and the like.

In testing the soil dispersing performance of the dispersing agents, the test method used in Example VII is followed. All fabrics display improved whiteness after laundering compared with fabrics which have not been exposed to the soil dispersing agents of the invention.

While the compositions and processes of the present invention are particularly useful in hand-wash fabric laundering operations, it is to be understood that they are also useful in any cleaning system which involves low water:fabric ratios. One such system is disclosed in U.S. Pat. No. 4,489,455, Spendel, issued Dec. 25, 1984, which involves a washing machine apparatus which contacts fabrics with wash water containing detersive ingredients using a low water:fabric ratio rather than the conventional method of immersing fabrics in an aqueous bath. Typically, the ratio of water:fabric ranges from about 0.5:1 to about 6:1 (liters of water:kg of fabric).

EXAMPLE X

Using the machine and operating conditions disclosed in U.S. Pat. No. 4,489,455, cited above, 25 grams of a composition according to Example IX herein are used to launder fabrics. If desired, sudsing of the composition can be minimized by incorporating therein from 0.2% to 2% by weight of a fatty acid, secondary alcohol, or silicone suds controlling ingredient.

Dishwashing Compositions

Another aspect of the present invention relates to dishwashing compositions, in particular automatic and manual dishwashing compositions, especially manual liquid dishwashing compositions.

Liquid dishwashing compositions according to the present invention preferably comprise from at least about 0.1%, more preferably from about 0.5% to about 30%, most preferably from about 1% to about 15% of the dispersing agent and from about 1% to about 99.9% of a detersive surfactant.

Liquid dishwashing compositions according to the present invention may comprise any of the ingredients listed herein above. In addition the dishwashing compositions may comprise other ingredients such as bactericides, chelants, suds enhancers, opacifiers and calcium and magnesium ions.

EXAMPLES XI

The following liquid compositions of the present invention are prepared by mixing the listed ingredients in the given amounts.

| | Composition (by weight %) | | | | | |
|---|---|---|---|---|---|---|
| Ingredients | A | B | C | D | E | F |
| Water | 28.0 | 34.0 | 30.0 | 41.0 | 41.0 | 36.0 |
| Ethanol | 13.0 | 8.0 | 8.0 | 8.0 | 8.0 | 8.0 |
| Linear dodecylbenzene sulfonic acid | 9.0 | 9.0 | 9.0 | 9.0 | 9.0 | 9.0 |
| Sodium cocoyl sulfate | 1.0 | — | 1.0 | — | — | — |
| Condensation product of 1 mole of $C_{13}$–$C_{15}$ oxoalcohol and 7 moles of ethylene oxide | 7.0 | — | — | — | 7.0 | — |
| Condensation product of 1 mole of $C_{13}$–$C_{15}$ oxoalcohol and 5 moles of ethylene oxide | — | 7.0 | 7.0 | 7.0 | — | 7.0 |
| $C_{12}$–$C_{14}$ (2hydroxyethyl)dimethyl ammonium chloride | — | 0.5 | 0.5 | — | 0.5 | 0.5 |
| Dodecenyl succinic acid | 12.5 | — | — | 10.0 | — | — |
| Dodecenyl-tetradecenyl succinic acid | — | — | — | — | 10.0 | — |
| TMS/TDS* | — | 12.5 | — | — | — | — |
| Sodium tripolyphosphate | — | — | 15.0 | — | — | — |
| Zeolite | — | — | — | — | — | 15.0 |
| Citric Acid | 1.0 | 3.0 | 2.8 | 2.8 | 3.0 | 2.8 |
| Oleic Acid | 3.0 | — | — | — | — | — |
| Diethylene triamine penta-methylene phosphonic acid | 0.7 | 0.7 | — | — | — | — |
| Hexamethylene diamine-tetra (methylene phosphonic acid) | — | — | 0.6 | — | — | 0.7 |
| Soil dispersing agent (Ex. 2) | 0.5 | 1.5 | 2.0 | 0.5 | 5.0 | 0.2 |
| Protease 8KNPU/g | 0.5 | — | — | — | — | — |
| Protease 16 KNPU/g | — | 0.3 | 0.3 | 0.3 | 0.3 | 0.3 |
| Amylase | 0.2 | — | — | — | — | 0.2 |
| Sodium formate | 1.0 | — | 1.5 | 1.0 | — | — |
| Sodium acetate | — | 2.5 | 2.5 | — | — | — |
| Magnesium acetate tetra-hydrate | 1.7 | — | 1.7 | 0.1 | — | — |
| Magnesium chloride hexa-hydrate | — | 1.7 | — | — | 0.1 | 0.7 |
| Sodium hydroxide | 5.0 | 5.0 | 5.0 | 5.0 | 5.0 | 5.0 |
| Perfume and minors | Balance to 100% | | | | | |

*(80:20) mixture of tartrate monosuccinate/tartrate disuccinate

EXAMPLE XII

An automatic dishwashing composition is as follows.

| Ingredient | % (Wt.) |
|---|---|
| Trisodium Citrate | 15 |
| Sodium Carbonate | 20 |
| Silicate[1] | 9 |
| Nonionic Surfactant[2] | 3 |
| Sodium Polyacrylate (m.w. 4000)[3] | 5 |
| Termamyl Enzyme (60T) | 1.1 |
| Savinase Enzyme (12T) | 3.0 |
| Soil dispersing Agent (Example I) | 1.0 |
| Minors | Balance to 100% |

[1]BRITESIL, PQ Corporation
[2]Polyethyleneoxide/polypropyleneoxide low sudser
[3]ACCUSOL, Rohm and Haas In the above composition, the surfactant may be replaced by an equivalent amount of any low-foaming, nonionic surfactant. Example include low-foaming or non-foaming ethoxylated straight-chain alcohols such as Plurafac™ RA series, supplied by Eurane Co., Lutensol™ LF series, supplied by BASF Co., Triton™ DF series, supplied by Rohm & Haas Co., and Synperonic™ LF series, supplied by ICI Co.

Automatic dishwashing compositions may be in granular, tablet, bar, or rinse aid form. Methods of making granules, tablets, bars, or rinse aids are known in the art. See, for instance, U.S. Ser. Nos. 08/106,022, 08/147,222, 08/147,224, 08/147,219, 08/052,860, 07/867,941.

All of the foregoing granular compositions may be provided as spray-dried granules or high density (above 600 g/l) granules or agglomerates. Such granules (which should not contain oxidizable components) can comprise, for example, water-soluble silicates, carbonates and the like.

While the foregoing examples illustrate the use of the present technology in cleaning/soil dispersing compositions designed for use in laundering and dishcare, it will be appreciated by those skilled in the art that the systems herein can be employed under any circumstance where improved soil dispersing is desired. Thus, the technology of this invention may be used, for example, to cleanse prosthetic devices such as dentures in dentifrice compositions and in any other circumstances where soil dispersing is advantageous to the user.

What is claimed is:

1. A soil dispersing composition comprising at least about 0.1% by weight of composition of an ethoxylated/propoxylated polyalkyleneamine polymer of the formula:

$$[(R^2)_2-N]_w-[R^1-\underset{\underset{B}{|}}{N}]_x-[R^1-\underset{\underset{R^2}{|}}{N}]_y-[R^1-\underset{\underset{(R^2)_2}{|}}{N}]_z$$

wherein each $R^1$ is independently $C_2$–$C_{12}$ alkylene, alkenylene, arylene or alkylarylene; each $R^2$ is independently H, a straight, branched or cyclic $C_1$–$C_8$ alkyl moiety, phenyl, benzyl, a $C_1$–$C_8$ aroyl or alkanoyl moiety, or the moiety —L—X wherein X is a nonionic group or an anionic group, and L is a hydrophilic chain which contains the polyalkylene moiety $[(R^5O)_{m'}(CH_2CH_2O)_{n'}-(R_5O)_{m''}(CH_2CH_2O)_{n''}]$, wherein each $R^5$ is independently H, $C_3$–$C_4$ alkylene or hydroxyalkylene, m'+m"=m, n'+n"=n, wherein m is from 0 to about 4, n is from 0 to about 16; provided that at least 0.5 of the $R^2$ moieties is —L—X; w is 1 or 0; x+y+z is at least 14; and B represents a continuation of this structure by branching; wherein said ethoxylated/propoxylated polyalkyleneamine polymer comprises a nitrogen-containing backbone with an average molecular weight of greater than 600 to about 10,0000; wherein said polymer has an average ethoxylation/propoxylation of from about 0.5 to about 10 per nitrogen and wherein said ethoxylated/propoxylated polyalkyleneamine polymer comprises a noncharged backbone or a charged backbone having no more than about 2 positive charges for every 40 nitrogen atoms present in the backbone.

2. A composition according to claim 1 wherein said ethoxylated/propoxylated polyalkyleneamine polymer comprises up to about 4 propoxylates per available site on the nitrogens.

3. A composition according to claim 1 further comprising from about 1% to about 55% of a detersive surfactant.

4. A laundry detergent composition comprising a soil dispersing composition according to claim 1; detersive surfactant selected from the group consisting of anionic, cationic, nonionic, zwitterionic, amphoteric surfactants and mixtures thereof; and optionally one or more ingredients selected from builders, enzymes, enzyme stabilizers, bleaching agents, bleach activators, soil release polymers, dispersents, fabric softeners, dye transfer inhibitors, carders, hydrotropes, dyes, pigments, carriers, and mixtures thereof.

5. An automatic dishwashing composition comprising a low-foaming nonionic surfactant and a soil dispersing composition according to claim 1.

6. A liquid detergent composition comprising a soil dispersing composition according to claim 1.

7. A detergent bar composition comprising a soil dispersing composition according to claim 1.

8. A method for improving the soil dispersing performance of detergent compositions wherein said improvement comprises adding thereto an effective amount of an ethoxylated/propoxylated polyalkyleneamine polymer of the formula:

$$[(R^2)_2-N]_w-[R^1-\underset{\underset{B}{|}}{N}]_x-[R^1-\underset{\underset{R^2}{|}}{N}]_y-[R^1-\underset{\underset{(R^2)_2}{|}}{N}]_z$$

wherein each $R^1$ is independently $C_2$–$C_{12}$ alkylene, alkylene, alkenylene, arylene or alkylarylene; each $R^2$ is independently H, a straight, branched or cyclic $C_1$–$C_8$ alkyl moiety, phenyl, benzyl, a $C_1$–$C_8$ aroyl or alkanoyl moiety, or the moiety —L—X wherein X is a nonionic group or an anionic group, and L is a hydrophilic chain which contains the polyalkylene moiety $[(R_5O)_{m'}(CH_2CH_2O)_{n'}-(R_5O)_{m''}(CH_2CH_2O)_{n''}$9 , wherein each $R^5$ is independently H, $C_3$–$C_4$ alkylene or hydroxyalkylene, m'+m"=m, n'+n"=n, wherein m is from 0 to about 4, n is from 0 to about 16; provided that at least 0.5 of the $R^2$ moieties is —L—X; w is 1 or 0; x+y+z is at least 14; and B represents a continuation of this structure by branching; wherein said ethoxylated/propoxylated polyalkyleneamine polymer comprises a nitrogen-containing backbone with an average molecular weight of greater than 600 to about 10,0000; wherein said polymer has an average ethoxylation/propoxylation of from about 0.5 to about 10 per nitrogen and wherein said ethoxylated/propoxylated polyalkyleneamine polymer comprises a noncharged backbone or a charged backbone having no more than about 2 positive charges for every 40 nitrogen atoms present in the backbone.

9. A method for whitening and/or cleaning fabrics, hard-surfaces, or dishes comprising contacting said fabrics, hard-surfaces, or dishes with an aqueous medium comprising an effective amount of a soil dispersing composition according to claim 1.

10. A method according to claim 9 wherein said aqueous medium comprises from about 0.1 ppm to about 700 ppm of said ethoxylated/propoxylated polyalkyleneamine polymer.

11. A method according to claim 9 wherein said aqueous medium has a pH of above about 9.

12. A method for dispersing non-polar soils, said method comprising adding to an aqueous medium containing non-polar soils an amount of a dispersing agent composition sufficient to effectively disperse said non-polar soils, said dispersing agent composition comprising at least about 0.1% by weight of composition of an ethoxylated/propoxylated polyalkyleneamine polymer of the formula:

$$[(R^2)_2-N]_w-[R^1-\underset{\underset{B}{|}}{N}]_x-[R^1-\underset{\underset{R^2}{|}}{N}]_y-[R^1-\underset{\underset{(R^2)_2}{|}}{N}]_z$$

wherein each $R^1$ is independently $C_2$–$C_{12}$ alkylene, alkylene, alkenylene, arylene or alkylarylene; each $R^2$ is independently H, a straight, branched or cyclic $C_1$–$C_8$ alkyl moiety, phenyl, benzyl, a $C_1$–$C_8$ aroyl or alkanoyl moiety, or the moiety —L—X wherein X is a nonionic group or an anionic group, and L is a hydrophilic chain which contains the polyalkylene moiety $[(R_5O)_{m'}(CH_2CH_2O)_{n'}-(R_5O)_{m''}(CH_2CH_2O)_{n''}]$, wherein each $R^5$ is independently H, $C_3$–$C_4$ alkylene or hydroxyalkylene, m'+m"=m, n'+n"=n, wherein m is from 0 to about 4, n is from 0 to about 16; provided that at least 0.5 of the $R^2$ moieties is —L—X; w is 1 or 0; x+y+z is at least 14; and B represents a continuation of this structure by branching; wherein said ethoxylated/propoxylated polyalkyleneamine polymer comprises a nitrogen-containing backbone with an average molecular weight of greater than 600 to about 10,0000; wherein said polymer has an average ethoxylation/propoxylation of from about 0.5 to about 10 per nitrogen and wherein said ethoxylated/propoxylated polyalkyleneamine polymer comprises a noncharged backbone or a charged backbone having no more than about 2 positive charges for every 40 nitrogen atoms present in the backbone.

13. A laundry detergent composition comprising:

(a) at least about 1% by weight of a detersive surfactant;

(b) at least about 1% by weight of a builder; and (c) at least about 0.1% by weight of a soil dispersing ethoxylated/propoxylated polyalkyleneamine polymer of the formula:

$$[(R^2)_2-N]_w-[R^1-\underset{\underset{B}{|}}{N}]_x-[R^1-\underset{\underset{R^2}{|}}{N}]_y-[R^1-\underset{\underset{(R^2)_2}{|}}{N}]_z$$

wherein each $R^1$ is independently $C_2$–$C_{12}$ alkylene, alkylene, alkenylene, arylene or alkylarylene; each $R^2$ is independently H, a straight, branched or cyclic $C_1$–$C_8$ alkyl moiety, phenyl, benzyl, a $C_1$–$C_8$ aroyl or alkanoyl moiety, or the moiety —L—X wherein X is a nonionic group or an anionic group, and L is a hydrophilic chain which contains the polyalkylene moiety $[(R_5O)_{m'}(CH_2CH_2O)_{n'}-(R_5O)_{m''}(CH_2CH_2O)_{n''}]$, wherein each $R^5$ is independently H, $C_3$–$C_4$ alkylene or hydroxyalkylene, m'+m"=m, n'+n"=n, wherein m is from 0 to about 4, n is from 0 to about 16; provided that at least 0.5 of the $R^2$ moieties is —L—X; w is 1 or 0; x+y+z is at least 14; and B represents a continuation of this structure by branching; wherein said ethoxylated/propoxylated polyalkyleneamine polymer comprises a nitrogen-containing backbone with an average molecular weight of greater than 600 to about 10,0000; wherein said polymer has an average ethoxylation/propoxylation of from about 0.5 to about 10 per nitrogen and wherein said ethoxylated/propoxylated polyalkyleneamine polymer comprises a noncharged backbone or a charged backbone having no more than about 2 positive charges for every 40 nitrogen atoms present in the backbone.

14. A composition according to claim 13 comprising detersive surfactants selected from the group consisting of anionic, cationic, nonionic, zwitterionic, amphoteric surfactants, and mixtures thereof.

15. A composition according to claim 14 comprising detersive surfactants selected from the group consisting of $C_{11}$–$C_{18}$ alkyl benzene sulfonates, $C_{10}$–$C_{18}$ secondary (2,3) alkyl sulfates, $C_{10}$–$C_{20}$ alkyl sulfates, $C_{10}$–$C_{18}$ alkyl alkoxy sulfates, $C_{12}$–$C_{18}$ alkyl ethoxylates, $C_{10}$–$C_{18}$ amine oxides, $C_{10}$–$C_{18}$ N-alkyl polyhydroxy fatty acid amides, and mixtures thereof.

16. A composition according to claim 13 wherein the builder is selected from the group consisting of alkali metal silicates, aluminosilicates, carbonates, polycarboxylates, citrate, and mixtures thereof.

17. A composition according to claim 16 wherein the builder comprises a zeolite builder.

18. A laundry detergent composition comprising:

a) at least about 1% by weight of a detersive surfactant;

b) at least about 1% by weight of a builder; and c) at least about 0.1% by weight of a soil dispersing ethoxylated/propoxylated polyalkyleneamine polymer of the formula:

$$[(R^2)_2-N]_w-[R^1-\underset{\underset{B}{|}}{N}]_x-[R^1-\underset{\underset{R^2}{|}}{N}]_y-[R^1-\underset{\underset{(R^2)_2}{|}}{N}]_z$$

wherein each $R^1$ is independently $C_2$–$C_{12}$ alkylene, alkenylene, arylene or alkylarylene; each $R^2$ is independently H, a straight, branched, or cyclic $C_1$–$C_8$ alkyl moiety, phenyl, benzyl, a $C_1$–$C_8$ aroyl or alkanoyl moiety, or the moiety —L—X, wherein X is a nonionic group or an anionic group, and L is a hydrophilic chain which contains the polyalkylene moiety $[(R^5O)_{m'}(CH_2CH_2O)_{n'}-(R_5O)_{m''}(CH_2CH_2O)_{n''}]$, wherein each $R^5$ is independently H, $C_3$–$C_4$ alkylene or hydroxyalkylene, m'+m"=m, n'+n"=n, wherein m is from 0 to about 4, n is from 0 to about 16, m+n is from about 1 to about 16; provided that at least 0.5 of the $R^2$ moieties is —L—X; w is 1 or 0; x+y+z is at least 14; and B represents a continuation of this structure by branching; wherein said ethoxylated/propoxylated polyalkyleneamine polymer comprises a nitrogen-containing backbone with an average molecular weight of from about 600 to about 10,000; wherein said polymer has an average ethoxylation/propoxylation of from about 0.5 to about 10 per nitrogen; and wherein said ethoxylated/propoxylated polyalkyleneamine polymer comprises a noncharged backbone or a charged backbone having no more than about 2 positive charges for every 40 nitrogen atoms present in the backbone.

* * * * *

UNITED STATES PATENT AND TRADEMARK OFFICE

CERTIFICATE OF CORRECTION

PATENT NO. : 5,565,145

DATED : October 15, 1996

INVENTOR(S) : Randall Alan Watson, et al.

It is certified that error appears in the above-identified patent and that said Letters Patent is hereby corrected as shown below:

In Column 1, line 44, change "drying" to --driving--.

In Column 2, line 66, change "suffactants" to --surfactants--.

In Column 8, line 54, change "titrate" to --citrate--.

In Column 10, line 38, change "titrate" to --citrate--.

In Column 16, line 16, change "mount" to --amount--.

In Column 22, line 54, change "mounts" to --amounts--.

In Column 24, line 17, change "Modem" to --Modern--.

In Column 25, line 45, change "carders" to --carriers--.

In Column 35, line 61, change "carders" to --carriers--.

Signed and Sealed this

Eighth Day of July, 1997

Bruce Lehman

*Attest:*

BRUCE LEHMAN

*Attesting Officer*

*Commissioner of Patents and Trademarks*